US006581569B2

(12) United States Patent
Arsic et al.

(10) Patent No.: US 6,581,569 B2
(45) Date of Patent: Jun. 24, 2003

(54) VALVE CONTROL UNIT FOR AN INTERNAL COMBUSTION ENGINE

(75) Inventors: Mirko Arsic, Berlin (DE); Michael Jäger, Berlin (DE); Isao Fukumoto, Berlin (DE); Detlev Oellrich, Berlin (DE); Günter Preub, Berlin (DE); Edward Wieczorek, Potsdam (DE)

(73) Assignee: Pierburg GmbH, Neuss (DE)

( * ) Notice: Subject to any disclaimer, the term of this patent is extended or adjusted under 35 U.S.C. 154(b) by 0 days.

(21) Appl. No.: 09/859,108

(22) Filed: May 16, 2001

(65) Prior Publication Data

US 2001/0045203 A1 Nov. 29, 2001

(51) Int. Cl.[7] ..... F02D 7/00
(52) U.S. Cl. ..... 123/399; 123/361
(58) Field of Search ..... 123/337, 399, 123/361; 251/129.11; 73/116, 117.3, 118.1, 118.2

(56) References Cited

U.S. PATENT DOCUMENTS

| | | | | |
|---|---|---|---|---|
| 5,672,818 A | * | 9/1997 | Schaefer et al. | 73/116 |
| 5,698,778 A | | 12/1997 | Ban et al. | 73/118.1 |
| 5,868,114 A | * | 2/1999 | Kamimura et al. | 123/399 |
| 6,009,853 A | | 1/2000 | Fujikawa et al. | 123/396 |
| 6,341,593 B2 | * | 1/2002 | Kamimura et al. | 123/337 |
| 6,390,062 B1 | * | 5/2002 | Saito et al. | 123/361 |
| 6,407,543 B1 | * | 6/2002 | Hagio et al. | 123/617 |

FOREIGN PATENT DOCUMENTS

| | | |
|---|---|---|
| DE | 1952510 | 1/1997 |
| DE | 19903490 | 8/2000 |
| JP | 2000130210 | 5/2000 |

OTHER PUBLICATIONS

Patent Abstracts of Japan of JP 20001.30210 dated May 9, 2000.

* cited by examiner

*Primary Examiner*—Mahmoud M Gimie
(74) *Attorney, Agent, or Firm*—Ladas & Parry

(57) ABSTRACT

A valve control unit, especially for internal combustion engines, having a valve fixed on a valve spindle which is mounted for angular rotation in a valve body supporting a control motor for positioning the valve spindle. The motor is coupled to the valve spindle through a gear mechanism and is disposed in the valve body with a sensor unit for sensing an adjusted angular position of the valve spindle. A cover is provided to be fastened on the valve body and the cover supports an electric clutch element, a bearing for an end of the motor shaft of the control motor and functional parts of the control motor such that assembly of the control motor is completed upon mounting the cover on the valve body.

17 Claims, 2 Drawing Sheets

VALVE CONTROL UNIT FOR AN INTERNAL COMBUSTION ENGINE

BACKGROUND OF THE INVENTION

The invention relates to a valve control unit, particularly for internal combustion engines, in which a valve is fixed on a valve spindle which is rotatably mounted in a valve body for angular movement by a control motor for positioning the valve, the motor being coupled to the valve spindle through a gear mechanism, a sensor unit being provided for sensing an adjusted position of the valve spindle, a cover being mountable on the valve body and supporting an electric clutch element.

Such valve control units are used, for example, to control flow of exhaust gases in a return line to the engine or as throttle-valve control units in the intake line of the internal combustion engine.

Such a valve control unit is disclosed in German Patent Application DE-OS 195 25 510 A1. In this valve control unit, the control motor as well as a mechanism connecting the control motor with the valve spindle is disposed in the throttle body. Furthermore, the positioning gear disposed on the valve spindle is provided with wiper elements which cooperate with a potentiometer. The potentiometer as well as electric leads, an electric clutch element and a plug-in motor contact connecting the electric clutch to the motor are disposed in the cover. The arrangement of the electric motor clutch is constructionally complex and is also sensitive to dirt and vibration, which can lead to interruption of the electrical contact.

SUMMARY OF THE INVENTION

An object of the invention is to provide a valve control unit which avoids the disadvantages of the conventional arrangement as described above.

This object is achieved by providing a bearing for an end of the motor shaft of the control motor, together with functional parts of the control motor, on the cover such that assembly of the control motor is completed upon mounting the cover on the valve body.

The valve control unit of the invention thereby can be made in particularly simple manner and at low cost. By mounting the bearing for the end of the motor shaft as well as important functional parts of the control motor on the cover, the complete electric motor clutch is obviated. The motor is assembled simply by mounting the cover in place on the valve body. A further advantage of this arrangement is that the output of motor power through the gear mechanism now takes place between two bearing points, whereby the force distribution on the motor shaft takes place in much more favorable manner.

DETAILED DESCRIPTION

Figure 1:
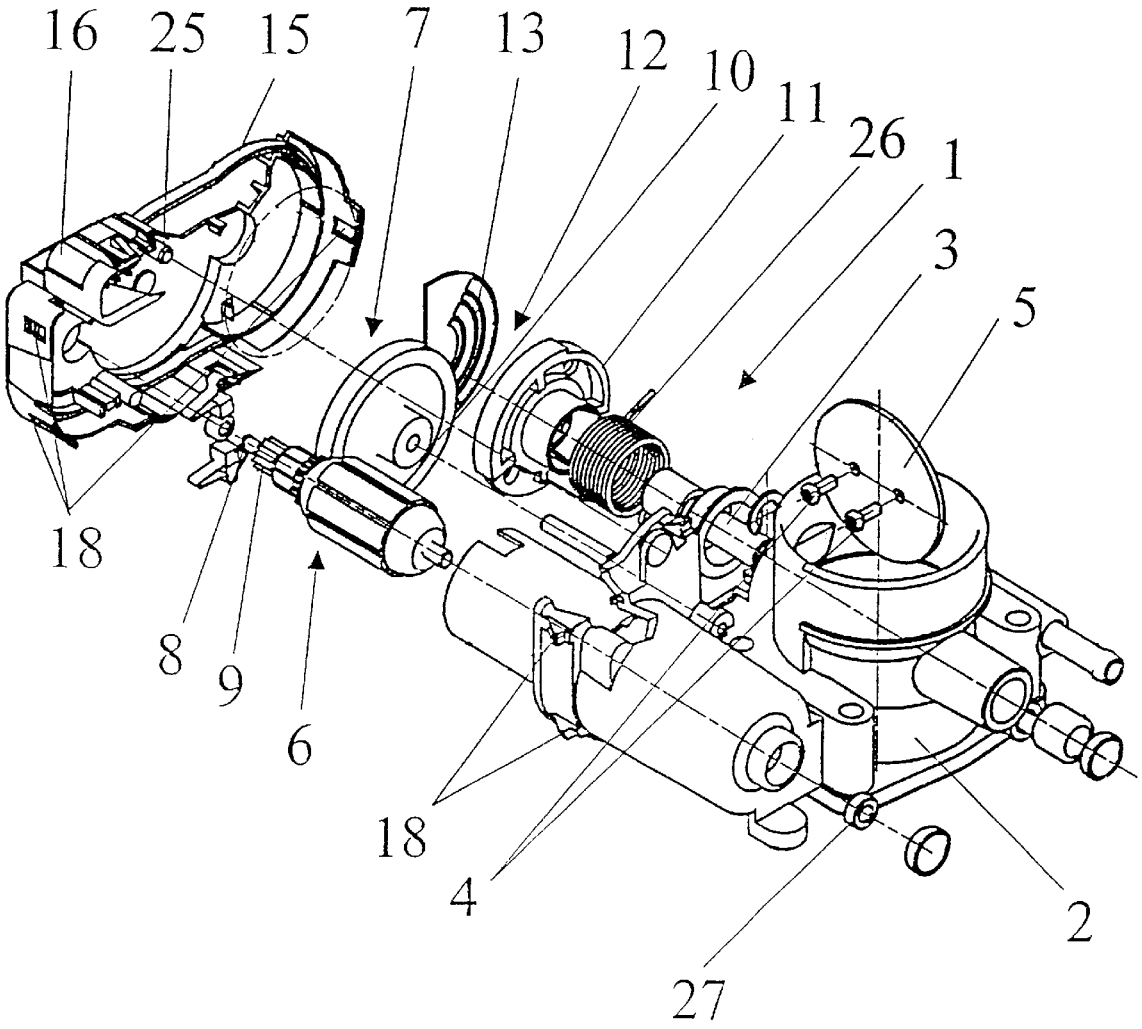
FIG. 1 is an exploded view of a valve control unit according to the invention.

FIG. 1 is an exploded view of a valve control unit 1 according to the invention, which is designed as a throttle valve control unit. The throttle valve control unit 1 includes a throttle valve body 2, in which a throttle valve spindle 3 is rotatably supported for angular movements. On this throttle valve spindle 3 there is fixed a throttle valve 5 by means of screws 4. For angularly adjusting the position of the throttle valve, the throttle valve control unit 1 is provided with a control motor 6, which is disposed in throttle valve body 2. The control motor 6 is drivingly engaged with the throttle valve spindle 3 by a gear mechanism 7. As illustrated in more detail in FIG. 2, the mechanism 7 comprises a pinion 9 fixed on a motor shaft 8, an intermediate gear 10 and a positioning gear 11 on throttle valve spindle 3. A sensor unit 12 for sensing an adjusted position of throttle valve spindle 3 comprises potentiometer tracks 13, which cooperate in conventional manner with wiper elements 14. Potentiometer tracks 13 are secured in a cover 15, which is pushed onto throttle valve body 2 in order to be mounted thereon. Electric leads (not illustrated), are disposed in cover 15 to connect sensor element 12 to an electric clutch element 16 disposed on cover 15. Electric clutch element 16 is also connected by electric leads directly to functional parts of the electric motor that are disposed in cover 15, and is provided with an output to the power supply and to an onboard electronic system. Cover 15 is also provided with centering elements 17, which ensure that cover 15 fits accurately when mounted on throttle valve body 2. Snap-engagement elements 18, serve to securely connect the cover 15 on the body 2. An engaging safeguard unit 25 functions as a lock to identify unauthorized opening.

Figure 2:
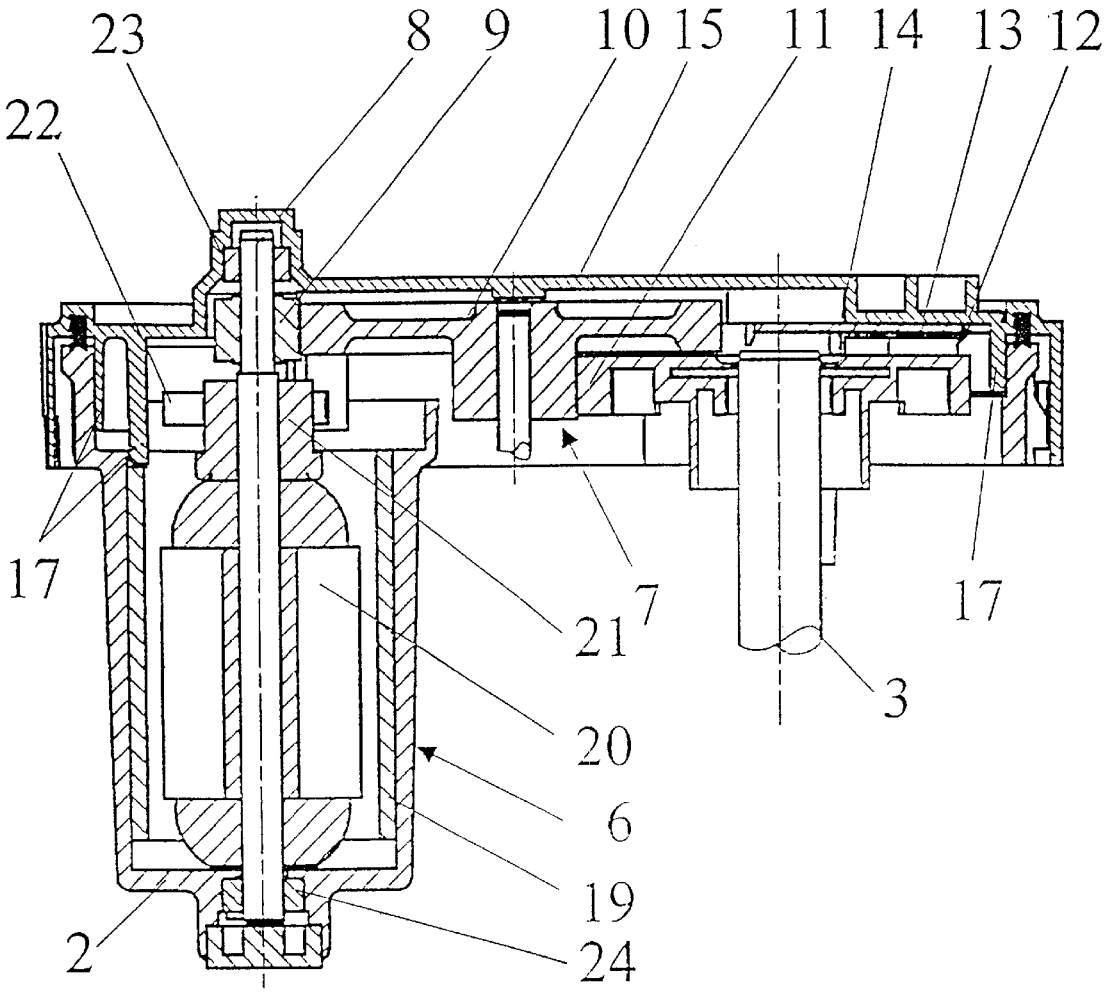
FIG. 2 is a sectional view through the assembled valve control unit.

FIG. 2 shows a section through cover 15, control motor 6 and gear mechanism 7 of the throttle valve control unit 1. The control motor is a DC motor with a pole ring 19, an armature 20 and a collector 21, which is contacted by brushes 22. In the preassembled condition, cover 15 is provided with a bearing 23 to support the end of the motor shaft 8 at the cover as well as with brushes 22, through which the control motor is energized.

The gear mechanism 7 comprises, in known manner, pinion 9 secured on motor shaft 8, intermediate gear 10 and positioning gear 11. Pinion 9 is disposed between bearings 22, 24 of the motor shaft and thereby a favorable distribution of force to motor shaft 8 is achieved. As already mentioned, sensor unit 12 comprises wiper elements 14, which cooperate in known manner with potentiometer tracks 13. It should be noted that other sensor units can also be used in the present throttle valve control unit, such as contactless sensor units that operate according to the capacitive, magnetoresistive or Hall-effect principle.

The throttle valve control unit can be assembled in the following sequence. Potentiometer tracks 13 are secured in the cover either directly or, as illustrated, by an intermediate element. The potentiometer tracks 13 together with the intermediate element can also be pushed in the cover, in which case guide elements ensure an accurately fitting arrangement in the cover. By means of spring elements provided on the cover, a biasing force is applied to the intermediate element, automatically ensuring electrical contact with clutch element 16. A circumferential seal ring (not illustrated) can also be provided on cover 15. Bearing 23 is then inserted in cover 15. Thereafter, brush elements 22 are fixed in cover 15, and motor shaft 8 together with collector 21, with which brush elements 22 are to be engaged, is introduced into bearing 23, whereupon gear 10, which is engaged with pinion 9, also becomes disposed in cover 15.

Positioning gear 11, throttle valve spindle 3, throttle valve 5, coupling spring 26, motor bearing 27 and pole ring 19 are now inserted in known manner in throttle valve body 2.

Cover 15 and throttle valve body 2 can now be joined together, whereupon snap-engaging connection elements 18 and engaging safeguard unit 25 become latched and lock the throttle valve control unit 1 in place.

Although the invention is disclosed with reference to particular embodiments thereof, it will become apparent to those skilled in the art that numerous modifications and variations can be made which will fall within the scope and spirit of the invention as defined by the attached claims.

What is claimed is:

1. A valve unit for an internal combustion engine comprising:

a valve body, a valve in said valve body, said valve being secured to a valve spindle which controls said valve, a control motor for operating said valve spindle to control said valve, a gear mechanism drivingly connecting said motor and thereby said valve spindle, a sensor unit for sensing position of said valve spindle and thereby of said valve, and a cover attachable on said valve body, said cover supporting a clutch element, controlling power supply to said control motor, said control motor including a motor shaft having one end extending in said cover, said cover supporting functional elements of said motor and including a bearing for supporting said one end of said motor shaft, said cover being mountable on said valve body to engage said one end of said motor shaft and said bearing and to operatively assemble said motor with its said functional parts.

2. The valve unit of claim 1, wherein said motor is a DC motor.

3. The valve unit of claim 2, wherein said functional parts of said motor comprise brushes.

4. The valve unit of claim 3, wherein said brushes are fixed in said cover.

5. The valve unit of claim 4, wherein said motor further includes collector elements on said motor shaft, said collector elements engaging said brushes when said cover and said valve body are mounted together.

6. The valve unit of claim 5, wherein said gear mechanism comprises a pinion secured to said motor shaft, an intermediate gear meshing with said pinion and a positioning gear on said spindle meshing with said intermediate gear.

7. The valve unit of claim 6, wherein said pinion is positioned between said bearing and said collector elements of the motor.

8. The valve unit of claim 1, wherein said sensor unit comprises first and second electrical elements for sensing position of said valve, said first electrical element being fixed to said cover and said second electrical element being secured with said spindle.

9. The valve unit of claim 8, wherein said first electrical element comprises potentiometer tracks secured to said cover and said second electrical element comprises wiper elements secured with said spindle and in operative association with said potentiometer tracks.

10. The valve unit of claim 1, comprising centering elements for centering the cover and the valve body when they are mounted together.

11. The valve unit of claim 1, comprising snap-engaging means connecting the cover and the valve body when they are mounted together.

12. A valve unit for an internal combustion engine comprising:

a valve body, a valve in said valve body, said valve being secured to a valve spindle which controls said valve, a control motor for operating said valve spindle to control said valve, a gear mechanism drivingly connecting said motor and thereby said valve spindle, a sensor unit for sensing position of said valve spindle and thereby of said valve, and a cover attachable on said valve body, said cover supporting a clutch element, controlling power supply to said control motor, said control motor including a motor shaft having one end extending in said cover, said cover supporting functional elements of said motor and including a bearing for supporting said one end of said motor shaft, said cover being mountable on said valve body to engage said bearing in said cover with said one end of said motor shaft and said bearing and to operatively assemble said motor with its said functional parts, said motor being a DC motor, said functional parts of said motor comprising brushes, said brushes being fixed in said cover, said motor including collector elements on said motor shaft, said collector elements engaging said brushes when said cover and said valve body are mounted together.

13. The valve unit of claim 12, wherein said gear mechanism comprises a pinion secured to said motor shaft, an intermediate gear meshing with said pinion and a positioning gear on said spindle meshing with said intermediate gear.

14. The valve unit of claim 13, wherein said pinion is positioned between said bearing and said collector elements of the motor.

15. The valve unit of claim 12, wherein said sensor unit comprises first and second electrical elements for sensing position of said valve, said first electrical element being fixed to said cover and said second electrical element being secured with said spindle, said first electrical element comprising potentiometer tracks secured to said cover and said second electrical element comprising wiper elements secured with said spindle and in operative association with said potentiometer tracks.

16. The valve unit of claim 12, wherein said cover is engageable on said valve body for being mounted thereon, and centering elements are provided for centering the cover and the valve body when the cover is engaged on the valve body.

17. The valve unit of claim 16, comprising snap-engaging means connecting the cover and the valve body when the cover is mounted on the valve body.

* * * * *

UNITED STATES PATENT AND TRADEMARK OFFICE

CERTIFICATE OF CORRECTION

PATENT NO. : 6,581,569 B2
DATED : June 24, 2003
INVENTOR(S) : Mirko Arsic et al.

It is certified that error appears in the above-identified patent and that said Letters Patent is hereby corrected as shown below:

Title page,
Add item:
-- [30] Foreign Application Priority Data
May 19, 2000 (DE) …. 100 24 426.2 --.

Signed and Sealed this

Fourth Day of November, 2003

JAMES E. ROGAN
*Director of the United States Patent and Trademark Office*